US008264300B2

(12) United States Patent
Cisco

(10) Patent No.: US 8,264,300 B2
(45) Date of Patent: Sep. 11, 2012

(54) TUNABLE TRANSMISSION LINE TIME DELAY CIRCUIT HAVING CONDUCTIVE FLOATING STRIP SEGMENTS CONNECTED BY SWITCHES

(75) Inventor: Terry Cisco, Glendale, CA (US)

(73) Assignee: Raytheon Company, Waltham, MA (US)

( * ) Notice: Subject to any disclaimer, the term of this patent is extended or adjusted under 35 U.S.C. 154(b) by 170 days.

(21) Appl. No.: 12/500,544

(22) Filed: Jul. 9, 2009

(65) Prior Publication Data

US 2011/0006859 A1 Jan. 13, 2011

(51) Int. Cl.
*H01P 1/18* (2006.01)

(52) U.S. Cl. ..... 333/161; 333/164

(58) Field of Classification Search ..... 333/156, 333/161, 164

See application file for complete search history.

(56) References Cited

U.S. PATENT DOCUMENTS

| | | | | |
|---|---|---|---|---|
| 4,914,407 | A | 4/1990 | Itoh | |
| 6,281,838 | B1 * | 8/2001 | Hong | 342/371 |
| 6,559,737 | B1 | 5/2003 | Nagra et al. | |
| 6,879,289 | B2 * | 4/2005 | Hayes | 333/161 |
| 6,950,590 | B2 | 9/2005 | Cheung et al. | |
| 7,259,641 | B1 * | 8/2007 | Weller et al. | 333/161 |
| 7,274,262 | B2 | 9/2007 | Ham et al. | |
| 7,332,983 | B2 | 2/2008 | Larson | |
| 7,852,176 | B2 * | 12/2010 | Chang et al. | 333/246 |
| 2004/0155728 | A1 | 8/2004 | Cheung et al. | |
| 2008/0204170 | A1 | 8/2008 | Chang et al. | |

OTHER PUBLICATIONS http://www.microwaves101.com/encyclopedia/coplanarwaveguide.cfm; "Coplanar waveguide"; Mar. 30, 2009; 4 pages.

Microwaves101.com-Microwave Encyclopedia; "Slow-wave structures"; Apr. 10, 2008; 3 pages.

Palei W., et al., "Optimization of Design and Fabrication for Micromachined True Time Delay (TTD) Phase Shifters", Sensors and Actuators A, Elsevier Sequoia S.A., Lausanne, CH, LNKD-DOI:10.1016/J. SNA 2004.10.005, vol. 119, No. 2, Apr. 13, 2006, pp. 446-454.

European Search Report for European Application No. 10251209.2-2220, European Search Report dated Sep. 20, 2010 and mailed Oct. 1, 2010 (6 pgs.).

Communication Pursuant to Article 94(3) EPC for European Application No. 10 251 209.2-2220, European Communication mailed Jun. 18, 2012 (6 pages).

* cited by examiner

*Primary Examiner* — Benny Lee

(74) *Attorney, Agent, or Firm* — Christie, Parker & Hale, LLP

(57) ABSTRACT

A tunable compact time delay circuit assembly is provided. In one embodiment, the invention relates to a tunable delay circuit assembly for controllably delaying signals that propagate along a transmission line, the circuit assembly including an elongated conductor extending in a first direction, the elongated conductor configured to carry the signals, at least one floating strip, each floating strip including a first elongated conductive segment having a first centerline, wherein the first centerline is not parallel to the first direction, and a second elongated conductive segment having a second centerline, wherein the second centerline is not parallel to the first direction, and a first switch coupled between the first segment and the second segment, wherein the first switch, in a first position, is configured to connect the first segment to the second segment, wherein the first switch, in a second position, is configured to electrically isolate the first segment from the second segment, and wherein the at least one floating strip is electrically isolated from other components of the circuit assembly.

13 Claims, 5 Drawing Sheets

*FIG. 6*

TRANSISTOR SWITCHES SHORTED
LONG DELAY MODE

GRAPH 1

| FREQUENCY (GHz) | DB(\|S(1,1)\|) LOADED LINE | DB(\|S(2,1)\|) LOADED LINE | DB(\|S(2,2)\|) LOADED LINE | GD(2,1)(ps) LOADED LINE |
|---|---|---|---|---|
| 90 | −15.554 | −1.6078 | −15.583 | 12.184 |
| 91 | −14.749 | −1.6461 | −14.778 | 12.15 |
| 92 | −14.056 | −1.6838 | −14.085 | 12.082 |
| 93 | −13.46 | −1.7202 | −13.488 | 12.012 |
| 94 | −12.947 | −1.7549 | −12.974 | 11.943 |
| 95 | −12.508 | −1.7872 | −12.534 | 11.866 |
| 96 | −12.141 | −1.825 | −12.167 | 11.794 |
| 97 | −11.834 | −1.8593 | −11.859 | 11.737 |
| 98 | −11.582 | −1.8896 | −11.606 | 11.686 |
| 99 | −11.38 | −1.9157 | −11.404 | 11.641 |
| 100 | −11.227 | −1.937 | −11.25 | 11.621 |

*FIG. 7*

TRANSISTOR SWITCHES OPENED
SHORT DELAY MODE

GRAPH 2

| FREQUENCY (GHz) | DB(\|S(3,3)\|) LOADED LINE | DB(\|S(4,3)\|) LOADED LINE | DB(\|S(4,4)\|) LOADED LINE | GD(4,3)(ps) LOADED LINE |
|---|---|---|---|---|
| 90 | −19.049 | −0.95621 | −18.136 | 7.4951 |
| 91 | −18.906 | −0.96454 | −18.003 | 7.4944 |
| 92 | −18.783 | −0.97194 | −17.892 | 7.493 |
| 93 | −18.681 | −0.9784 | −17.8 | 7.4921 |
| 94 | −18.598 | −0.98391 | −17.728 | 7.4917 |
| 95 | −18.534 | −0.98848 | −17.674 | 7.4901 |
| 96 | −18.492 | −0.99521 | −17.642 | 7.4891 |
| 97 | −18.469 | −1.001 | −17.629 | 7.4903 |
| 98 | −18.464 | −1.0058 | −17.633 | 7.4919 |
| 99 | −18.478 | −1.0098 | −17.656 | 7.4939 |
| 100 | −18.509 | −1.0127 | −17.697 | 7.495 |

TUNABLE TRANSMISSION LINE TIME DELAY CIRCUIT HAVING CONDUCTIVE FLOATING STRIP SEGMENTS CONNECTED BY SWITCHES

FIELD OF THE INVENTION

The present invention relates generally to time delay circuits for electronic systems. More specifically, the invention relates to a tunable compact time delay circuit assembly for delaying signals traveling along a transmission line.

BACKGROUND

In order to ensure that electronic signals or waveforms traveling along different paths arrive to the destination at a predetermined time, propagation delay techniques are used. To delay signal propagation, time delay circuits are preferred over increases in transmission line length for the delay purposes. In radar systems, time delay circuits can be used in conjunction with transmission lines to control beam steering in an active array radar system. The active array radar systems, or active electronically scanned arrays (AESA), are used to identify the range, altitude, direction, geometry or speed of both moving and fixed objects such as aircraft, ships, people, motor vehicles, weather formations, and terrain.

Conventional time delay circuits for transmission lines can consume considerable layout space and lack an ability to adjust delay. For example, increasing the length of a transmission line adds time delay, but often requires additional layout space that could be used for other purposes. Slow wave structures, which might require less layout space, have also been proposed for delaying signals traveling along transmission lines. U.S. Pat. No. 6,950,590, the entire content of which is expressly incorporated herein by reference, describes a conventional slow wave structure. The slow wave structure is typically implemented by placing floating strips of metal beneath a transmission line. The floating strips of metal beneath the transmission line act as periodic parasitic capacitance loads to the transmission line. U.S. Pat. No. 7,332,983 to Larson, the entire content of which is expressly incorporated herein by reference, describes a tunable delay line that selectively grounds one or more floating strips. However, the delay line of Larson requires manual tuning using a jumper or other connector. Therefore, a system providing dynamic control of time delay along a transmission line is desirable.

SUMMARY OF THE INVENTION

Aspects of the invention relate to a tunable compact time delay circuit assembly. In one embodiment, the invention relates to a tunable delay circuit assembly for controllably delaying signals that propagate along a transmission line, the circuit assembly including an elongated conductor extending in a first direction, the elongated conductor configured to carry the signals, at least one floating strip, each floating strip including a first elongated conductive segment having a first centerline, wherein the first centerline is not parallel to the first direction, and a second elongated conductive segment having a second centerline, wherein the second centerline is not parallel to the first direction, and a first switch coupled between the first segment and the second segment, wherein the first switch, in a first position, is configured to connect the first segment to the second segment, wherein the first switch, in a second position, is configured to electrically isolate the first segment from the second segment, and wherein the at least one floating strip is electrically isolated from other components of the circuit assembly.

BRIEF DESCRIPTION OF THE DRAWINGS

FIG. 6 is a table illustrating time delay produced by the tunable delay circuit assembly in a long delay mode in accordance with one embodiment of the invention.

FIG. 7 is a table illustrating time delay produced by the tunable delay circuit assembly in a short delay mode in accordance with one embodiment of the invention.

DETAILED DESCRIPTION OF THE INVENTION

Figure 1:
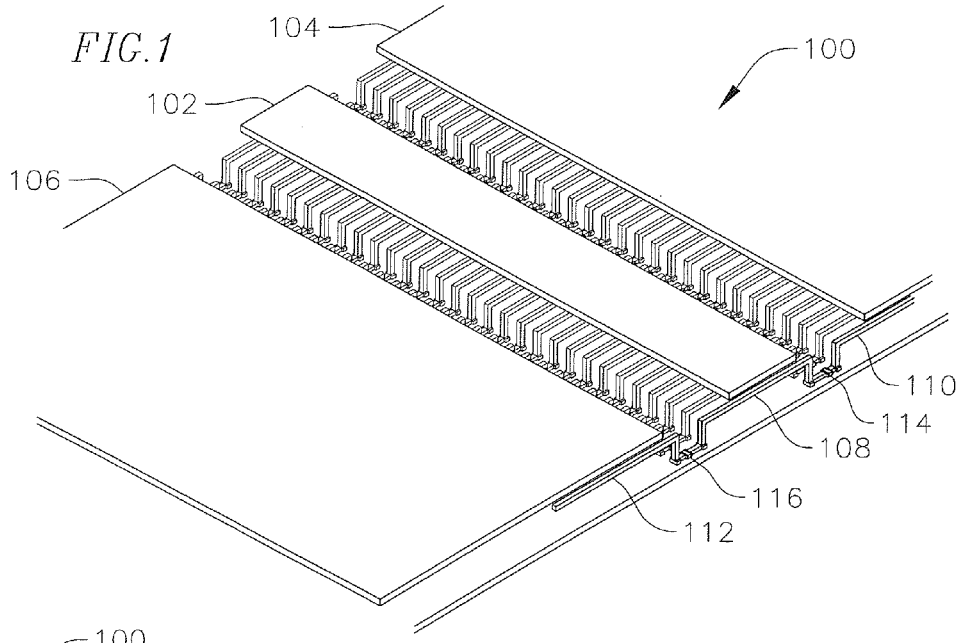
FIG. 1 is a perspective view of a tunable delay circuit assembly including a portion of a coplanar wave (CPW) transmission line and an array of floating strips having switchable floating segments in accordance with one embodiment of the invention.

Referring now to the drawings, where like features are designated by identical reference numbers, embodiments of tunable delay circuit assembly include switchable floating strips that modify the properties of a transmission line, thereby providing an adjustable delay of signals propagating along the transmission line. The switchable floating strips can include an array of floating strips arranged along a direction approximately perpendicular to the direction of the transmission line. The switchable floating strips include at least two floating segments separated by a switch. Each floating segment can provide a predetermined amount of parasitic capacitance. The array of floating strips including the floating segments can provide a predetermined periodic parasitic capacitance. By actuating the switch on one floating strip, thereby coupling the at least two floating segments, the effective parasitic capacitance of that floating strip is maximized and time delay is increased. With an array of floating strips having multiple floating segments coupled by switches, the delay can be adjusted as desired. In many embodiments, the floating strips include three floating segments and two switches. In a number of embodiments, the switches are transistors.

In various embodiments, the transmission line is a coplanar waveguide (CPW) transmission line having a center conductor separated by two ground plane conductors along the same plane and atop a dielectric medium. In such case, the floating strips can include three floating segments including a center segment disposed below the center conductor of the CPW transmission line and two outer segments disposed below each of the two ground plane conductors of the CPW transmission line. In this case, the floating strips further include two transistor switches disposed between the three segments.

In other embodiments, the floating strips of the tunable delay circuit assemblies can be used with other transmission lines and can include more than or less than three floating segments.

FIG. 1 is a perspective view of a tunable delay circuit assembly 100 including a portion of a coplanar wave transmission line and an array of floating strips having switchable floating segments in accordance with one embodiment of the invention. The CPW transmission line includes an elongated center conductor 102 between a first elongated ground plane 104 and a second elongated ground plane 106, where each component may be located within the same plane. Each floating strip includes a center segment 108 disposed below the center conductor 102, a first outer segment 110 disposed below the first ground plane 104, a second outer segment 112 disposed below the second ground plane 106, a first switch 114 coupled between the center segment 108 and the first outer segment 110, and a second switch 116 coupled between the center segment 108 and the second outer segment 112.

The elongated center conductor 102 and ground planes (104, 106) of the CPW transmission line extend in a first direction. In the embodiment illustrated in FIG. 1, each of the floating strips extend in a second direction that is perpendicular to the first direction. Each of the segments of the floating strip extend in the second direction and are collinear. In other embodiments, the second direction is not perpendicular to the first direction and the segments need not be collinear.

In the embodiment illustrated in FIG. 1, the tunable delay circuit assembly includes approximately thirty floating strips each having three floating segments separated by two switches. In other embodiments, the tunable delay circuit assembly can include more than or less than thirty floating strips. In some embodiments, the floating strips can include two floating segments separated by a single switch. In other embodiments, the floating strips can include more than three segments separated by additional switches.

In the embodiment illustrated in FIG. 1, the floating segments are shown to have particular lengths. In other embodiments, the floating segments can be longer or shorter than lengths depicted. In the embodiment illustrated in FIG. 1, the floating segments are disposed in particular positions with respect to the transmission line. In other embodiments, the floating segments can be positioned in other locations such that the segments provide some effective capacitance as seen by signals traveling along the transmission line. In one embodiment for example, the floating segments can be under or over the transmission line. In another embodiment, where the center conductor of the transmission line is higher or lower than the associated ground conductors, the floating segments can be positioned between the center conductor and the associated ground conductors. In a number of embodiments, the reactive capacitive loading is affected by the distance between the segments and the transmission line and the length of the segments. In many embodiments, such length and distance are preselected to achieve a particular capacitive loading.

In a number of embodiments, the switches can be transistors. In specific embodiments, the transistors can be complementary metal oxide semiconductor (CMOS) field effect transistors (FETs).

In many embodiments, the floating strips are electrically isolated from the CPW transmission line by a layer of dielectric material (not shown in FIG. 1). In a number of such embodiments, the floating strips are embedded in the dielectric layer.

Figure 2:
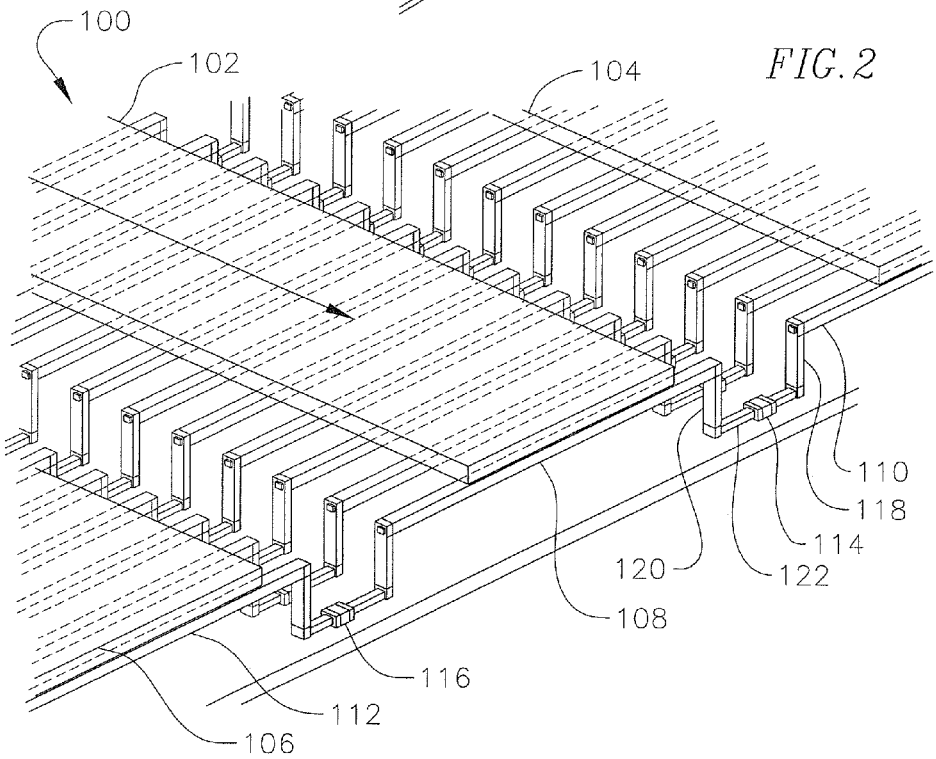
FIG. 2 is a magnified perspective transparent view of the tunable delay circuit assembly of FIG. 1.

FIG. 2 is a magnified perspective transparent view of the tunable delay circuit assembly 100 of FIG. 1. In FIG. 2, switch 114 is disposed on a plane below outer segment 110 and is coupled by vertical segments (118, 120) that can be formed by vias or other suitable conductors. The switch 114 is coupled to the vertical segments (118, 120) by a lower segment 122, which can be formed as a circuit trace, or other suitable conductors, on top of a lower layer. In other embodiments, the switches can be located on top of the same plane as the floating segments. In some of those embodiments, the switches can be collinear with the floating segments.

In operation, any one of the switches can be closed to increase the parasitic capacitance seen by signals traveling along the CPW transmission line. In closing the one switch, the floating segments are electrically coupled and provide a larger effective capacitance than the center floating segment would otherwise provide individually. Similarly, any one of the switches can be opened to decrease the effective parasitic capacitance seen by signals traveling along the CPW transmission line. In some embodiments, all of the switches are actuated together such that the tunable circuit assembly operates in either a short delay mode, where all switches are open, or a long delay mode, where all switches are closed. In other embodiments, other control schemes can be used and the number and position of switches can be varied.

In one embodiment, the CPW transmission line is made of aluminum and the floating strips are formed using copper. In other embodiments, other suitable conductive materials can be used. In some embodiments, the tunable delay circuit assembly is implemented using a silicon germanium integrated circuit, such as a monolithic microwave integrated circuit (MMIC). In such case, the silicon germanium process can provide multiple dielectric layers and other features advantageously suited for the tunable delay circuit assembly structure.

In many embodiments, the switches are controlled by an external device such as a microprocessor or other control circuitry. In some embodiments, the switches are controlled individually. In other embodiments, the switches are all controlled together or in groups. In some embodiments, each floating strip has one or more switches. In other embodiments, some floating strips have no switches while other floating strips include one or more switches. In some cases, the switches are randomly distributed among the floating strips. In a number of embodiments, the tunable delay circuit assemblies include a predetermined number of floating strips and switches to establish a predetermined time delay.

Figure 2A:
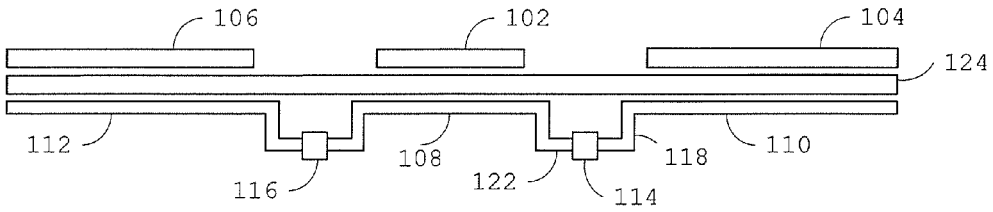
FIG. 2*a* is a side view of the tunable delay circuit assembly of FIG. 1.

FIG. 2*a* is a side view of the tunable delay circuit assembly of FIG. 1. The assembly includes a dielectric layer 124 positioned between upper layer components (102, 104, 106) and lower layer components (108, 110, 112).

Figure 2B:
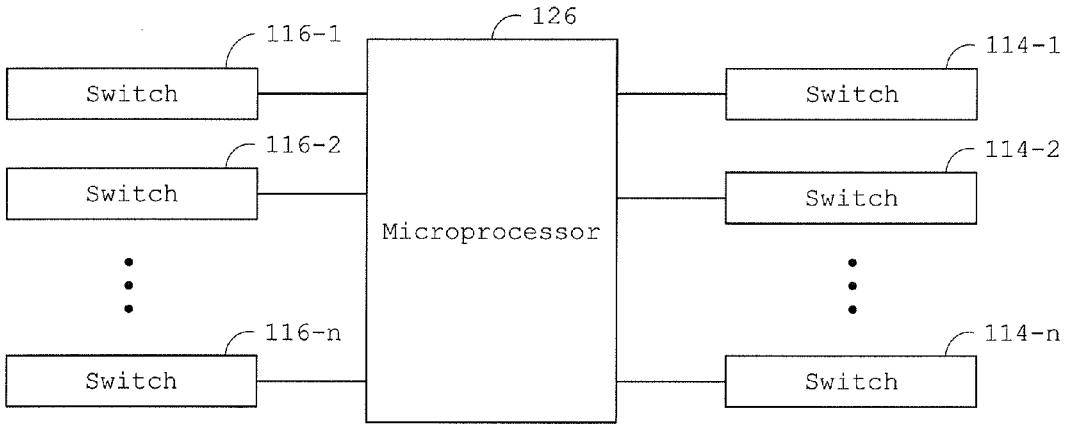
FIG. 2*b* is a block diagram of the tunable delay circuit assembly of FIG. 1.

FIG. 2*b* is a block diagram of the tunable delay circuit assembly of FIG. 1. The tunable delay circuit includes a microprocessor 126 coupled to a number of first switches (114-1, 114-2 to 114-n) and a number of second switches (116-1, 116-2 to 116-n).

Figure 3:
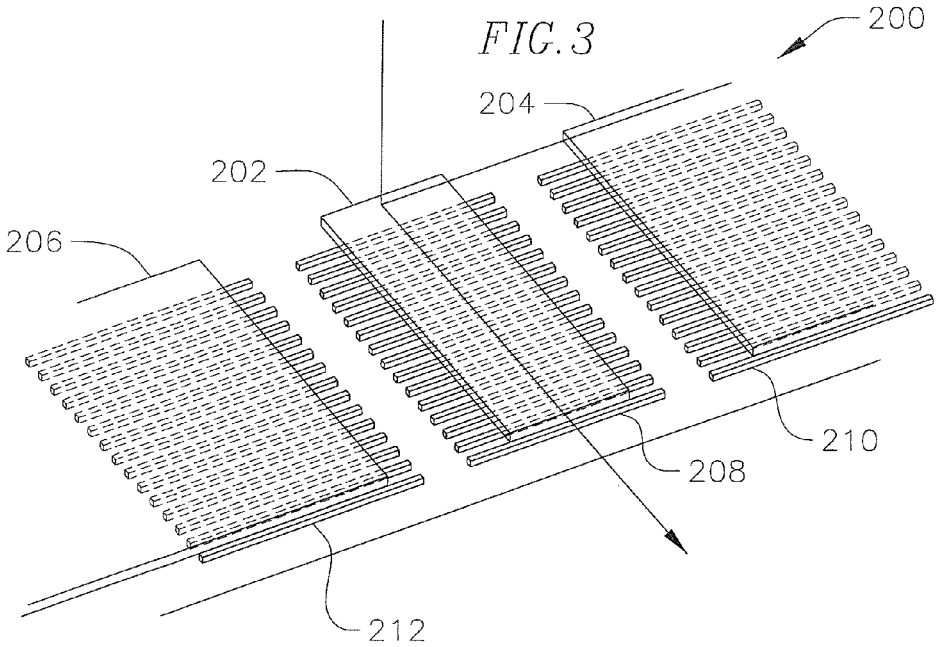
FIG. 3 is a perspective view of a tunable delay circuit assembly in a short delay mode, when the switches are open to isolate the floating segments, in accordance with one embodiment of the invention.

FIG. 3 is a perspective view of a tunable delay circuit assembly 200 in a short delay mode, when the switches (not shown) are open to isolate the floating segments, in accordance with one embodiment of the invention. The tunable delay circuit assembly 200 includes a CPW transmission line having an elongated center conductor 202 between a first elongated ground plane 204 and a second elongated ground plane 206, where each component is located along the same plane. Each floating strip includes a center segment 208 disposed below the center conductor 202, a first outer segment 210 disposed below the first ground plane 204, a second outer segment 212 disposed below the second ground plane 206, a first switch (not shown) coupled between the center segment 208 and the first outer segment 210, and a second switch (not shown) coupled between the center segment 208 and the second outer segment 212. In the embodiment shown in FIG. 3, the switches are all open for providing minimal time delay in the short delay mode.

Figure 4:
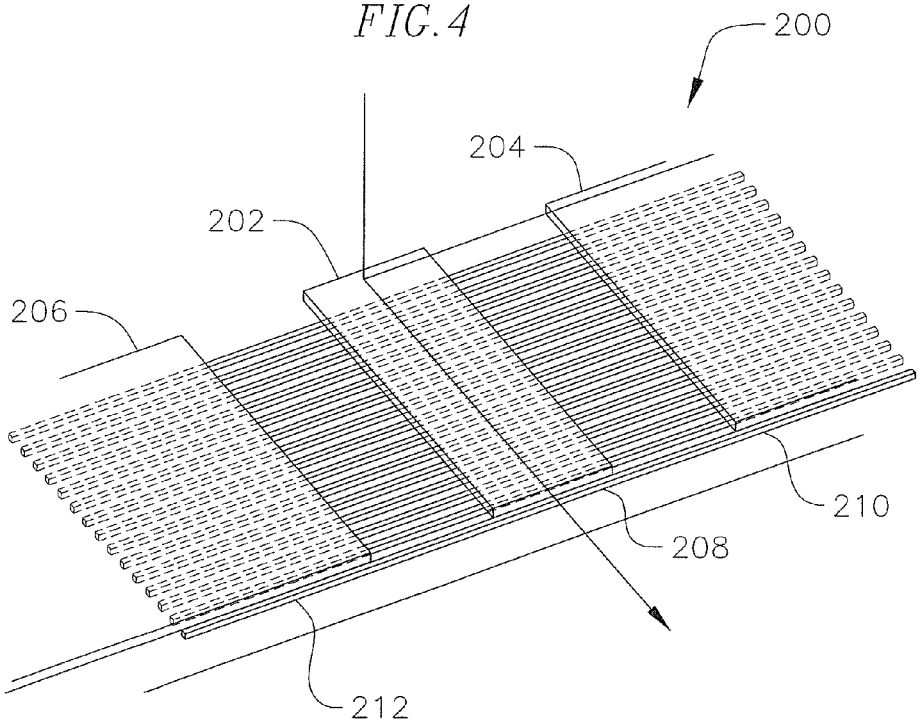
FIG. 4 is a perspective view of a tunable delay circuit assembly in a long delay mode, when the switches are closed to short the floating segments together, in accordance with one embodiment of the invention.

FIG. 4 is a perspective view of a tunable delay circuit assembly 200 in a long delay mode, when the switches (not shown) are closed to short the floating segments together, in accordance with one embodiment of the invention. The tunable delay circuit assembly 200 includes a CPW transmission line having an elongated center conductor 202 between a first elongated ground plane 204 and a second elongated ground plane 206, where each component is located along the same plane. Each floating strip includes a center segment 208 disposed below the center conductor 202, a first outer segment 210 disposed below the first ground plane 204, a second outer segment 212 disposed below the second ground plane 206, a first switch (not shown) coupled between the center segment 208 and the first outer segment 210, and a second switch (not shown) coupled between the center segment 208 and the second outer segment 212. In the embodiment shown in FIG. 4, the switches are all closed for providing maximum time delay in the long delay mode.

Figure 5:
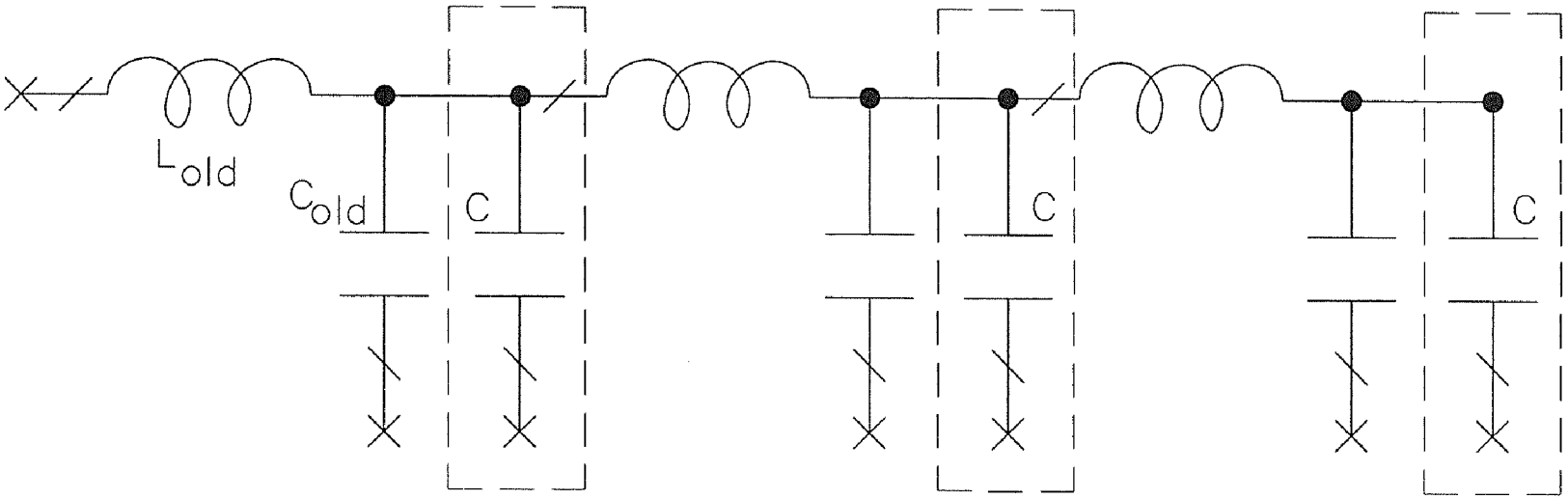
FIG. 5 is a schematic block diagram of a model for the impedance of a tunable delay circuit assembly including a model of a coplanar wave transmission line with an additional reactance provided by switchable floating segments in accordance with one embodiment of the invention.

FIG. 5 is a schematic block diagram of a model for the impedance of a tunable delay circuit assembly including a model of a coplanar wave transmission line with an additional capacitance provided by switchable floating segments in accordance with one embodiment of the invention. While not bound by any particular theory, a traditional transmission line can be modeled as a series of inductors and capacitors, assuming a lossless line. The components of the CPW transmission line representing a traditional transmission line includes inductor $L_{old}$ and capacitor $C_{old}$, which together have an effective impedance of $Z_{old}$. The floating strips add additional impedance in the form of capacitor C to the transmission line model.

The new total capacitance of the tunable delay circuit assembly $C_{new}$ is depicted below in equation (1):

$$C_{new}=C_{old}+(C/l) \tag{1}$$

where C/l is the capacitance per unit length of a capacitor of value C and a length l. Both Cnew and Cold are capacitance per unit length for a suitably short length of transmission line.

The new impedance ($Z_{new}$) of the transmission line of the tunable delay circuit assembly is depicted below in equation (2):

$$Z_{new}=\sqrt{\frac{L_{new}}{C_{new}}}=\sqrt{\frac{L_{old}}{C_{old}+(C/l)}}=\frac{Z_{old}}{\sqrt{1+(C/l)/C_{old}}} \tag{2}$$

The velocity ($v_{new}$) of signals traveling along the transmission line is proportional to the impedance, and therefore the velocity of such signals is as recited below in equation (3):

$$v_{new}=\frac{v_{old}}{\sqrt{1+(C/l)/C_{old}}} \tag{3}$$

In one embodiment, for example, the additional impedance in the form of parasitic capacitance per unit length (C/l) is three times the original transmission line capacitance ($C_{old}$) and the resulting velocity is cut in half while the time delay doubles.

In a number of embodiments, the switches used in the floating strips of the tunable delay circuit assembly are implemented using FETs. In such embodiments, the transistors can provide substantial capacitance to the floating strips. In some embodiments, the capacitance or capacitive effect provided by the transistors represents the dominant capacitive effect provided by the floating strips.

In some embodiments, the preselected capacitance of the floating strips is determined based on an analysis of a tradeoff associated with changing the impedance to create the time delay while minimizing the change to the characteristic impedance of the transmission line. In such case, multiple switches having individual control of floating strips can provide great flexibility in controlling the impedance and addressing the design tradeoff.

FIG. 6 is a table illustrating time delay produced by the tunable delay circuit assembly in a long delay mode (e.g., where the transistor switches are closed or shorted to provide greater delay) in accordance with one embodiment of the invention. The last column of the table shows the time delay (GD(2,1)) in picoseconds or ps produced by the tunable delay circuit assembly in the long delay mode at various frequencies ranging from 90 Gigahertz (GHz) to 100 GHz. In the long delay mode, the time delay is approximately 11-12 picoseconds. The remaining columns of the table illustrate the two-port transmission line characteristics for the transmission line of the tunable delay circuit assembly, including the return loss from port one (S(1,1)), the transmission coefficient (S(2,1)), and the return loss from port two (S(2,2)), in decibels or DB. The first column lists the frequencies tested in gigahertz or GHz, and the designation "LOADED LINE" indicates that the transmission line was loaded during the tests.

FIG. 7 is a table illustrating time delay produced by the tunable delay circuit assembly in a short delay mode (e.g., where the transistor switches are opened to provide less delay) in accordance with one embodiment of the invention. Similar to FIG. 6, the last column of the table shows the time delay in picoseconds produced by the tunable delay circuit assembly in the short delay mode at various frequencies ranging from 90 GHz to 100 GHz. In the short delay mode, the time delay (GD(4,3) in picoseconds or ps) is approximately 7 picoseconds, or nearly half of the time delay in the long delay mode. The remaining columns of the table illustrate the two-port transmission line characteristics for the transmission line of the tunable delay circuit assembly, including the return loss from port one (S(3,3)), the transmission coefficient (S(4,3)), and the return loss from port two (S(4,4)), in decibels or DB. The first column lists the frequencies tested in gigahertz or GHz, and the designation "LOADED LINE" indicates that the transmission line was loaded during the tests.

While the above description contains many specific embodiments of the invention, these should not be construed as limitations on the scope of the invention, but rather as examples of specific embodiments thereof. For example, in some embodiments, the floating strips and gaps between segments of the floating strips can be independently varied for specific time delay ranges as long as the low pass cutoff frequency of the assembly is not allowed to encroach on the operating bandwidth. Accordingly, the scope of the invention should be determined not by the embodiments illustrated, but by the appended claims and their equivalents.

What is claimed is:

1. A tunable delay circuit assembly for controllably delaying signals that propagate along a transmission line, the circuit assembly comprising:

an elongated conductor extending in a first direction, the elongated conductor configured to carry the signals;

a first elongated ground plane conductor extending in the first direction;

a second elongated ground plane conductor extending in the first direction; and a floating strip comprising:

a first elongated conductive segment having a first centerline, wherein the first centerline is not parallel to the first direction;

a second elongated conductive segment having a second centerline, wherein the second centerline is not parallel to the first direction;

a third elongated conductive segment extending along a third centerline;

a first switch coupled between the first segment and the second segment; and a second switch coupled between the first segment and the third segment;

wherein the first switch, in a first position, is configured to connect the first segment to the second segment;

wherein the first switch, in a second position, is configured to electrically isolate the first segment from the second segment;

wherein the second switch, in a first position, is configured to connect the first segment to the third segment;

wherein the second switch, in a second position, is configured to electrically isolate the first segment from the third segment; and wherein the floating strip is electrically isolated from other components of the circuit assembly.

2. The circuit assembly of claim 1, wherein the floating strip is configured to change transmission properties of the signals propagating along the transmission line.

3. The circuit assembly of claim 2, wherein the floating strip is configured to add capacitance to the transmission line.

4. The circuit assembly of claim 1:

wherein the first segment is disposed below the elongated conductor configured to carry the signals;

wherein the second segment is disposed below the first ground plane conductor; and wherein the third segment is disposed below the second ground plane conductor.

5. The circuit assembly of claim 4:

wherein the elongated conductor is disposed between the first ground plane conductor and the second ground plane conductor within a first plane;

wherein the first segment, the second segment, and the third segment are disposed on a second plane below the first plane; and wherein the first switch and the second switch are disposed on a third plane below the second plane.

6. The circuit assembly of claim 5, wherein the first switch and the second switch comprise FETs.

7. The circuit assembly of claim 1, further comprising circuitry coupled to the first switch and the second switch, wherein the circuitry is configured to control both the first and second switches.

8. The circuit assembly of claim 1, wherein the floating strip comprises an array of floating strips.

9. The circuit assembly of claim 1, wherein the first switch and the second switch comprise transistors.

10. The circuit assembly of claim 1, further comprising a dielectric material disposed between the elongated conductor and the floating strip.

11. The circuit assembly of claim 1, wherein the first centerline, the second centerline, and the third centerline are each approximately perpendicular to the first direction.

12. The circuit assembly of claim 1, wherein the elongated conductor is disposed between the first ground plane conductor and the second ground plane conductor within a first plane.

13. The circuit assembly of claim 1, wherein the first centerline, the second centerline and the third centerline are collinear.

* * * * *